US005792391A

United States Patent [19]

Vogel et al.

[11] Patent Number: 5,792,391

[45] Date of Patent: Aug. 11, 1998

[54] CARBONATOR

[75] Inventors: James D. Vogel, Anoka; Douglas P. Goulet, Big Lake, both of Minn.

[73] Assignee: IMI Cornelius Inc., Anoka, Minn.

[21] Appl. No.: 761,191

[22] Filed: Dec. 5, 1996

Related U.S. Application Data

[60] Provisional application No. 60/008,345 Dec. 7, 1995.

[51] Int. Cl.[6] ..... B01F 3/04

[52] U.S. Cl. ..... 261/121.1; 261/DIG. 7

[58] Field of Search ..... 261/DIG. 7, 121.1

[56] References Cited

U.S. PATENT DOCUMENTS

| | | | |
|---|---|---|---|
| 2,782,016 | 2/1957 | Iannelli | 261/DIG. 7 |
| 3,960,164 | 6/1976 | Kelley | 261/DIG. 7 |
| 4,187,262 | 2/1980 | Fessler et al. | 261/DIG. 7 |
| 4,265,376 | 5/1981 | Skidell | 261/DIG. 7 |
| 4,482,509 | 11/1984 | Iannelli | 261/DIG. 7 |
| 4,518,541 | 5/1985 | Harris | 261/DIG. 7 |
| 5,474,717 | 12/1995 | Bucher et al. | 261/DIG. 7 |

*Primary Examiner*—Tim R. Miles
*Attorney, Agent, or Firm*—Sten Erik Hakanson

[57] ABSTRACT

A carbonator comprising a tube cylinder having a closed and an open end. A disk is removably retained in the open end for providing access into the interior volume thereof. The disk provides for mounting thereto of water and carbon dioxide gas inlets, a carbonated water outlet, a safety relief valve and a water level sensor. A rigid retaining wire is bent into a square configuration wherein radiussed corners thereof cooperate with slots in the open end of the cylinder to retain the disk therein. Manipulation of the retaining wire provides for removal of the disk from the cylinder when the carbonator is not pressurized.

15 Claims, 7 Drawing Sheets

48
50
50
52
50
52
52
17
20
20
16
40
42
36
30
34
22
44
28
27a
40a
18
20
38
24
26
40b
33a
35
33c
33b
14

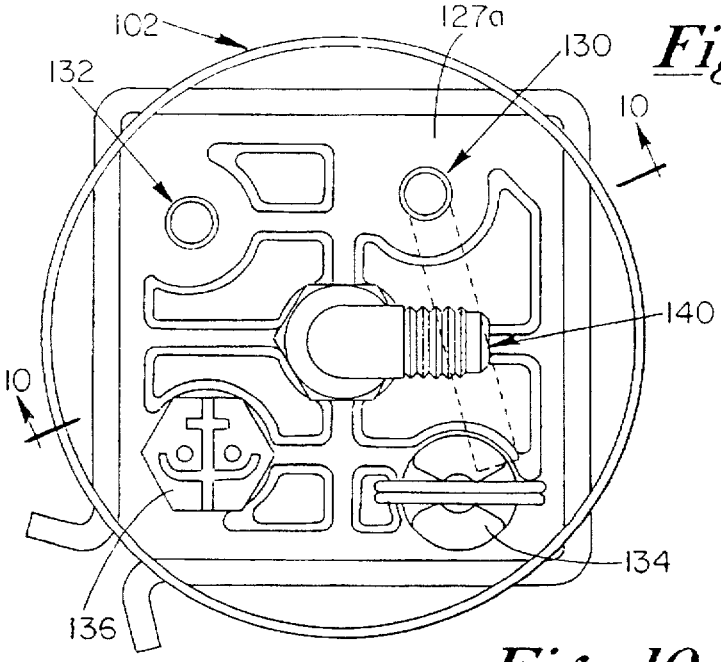
Fig.-9
Fig.-10
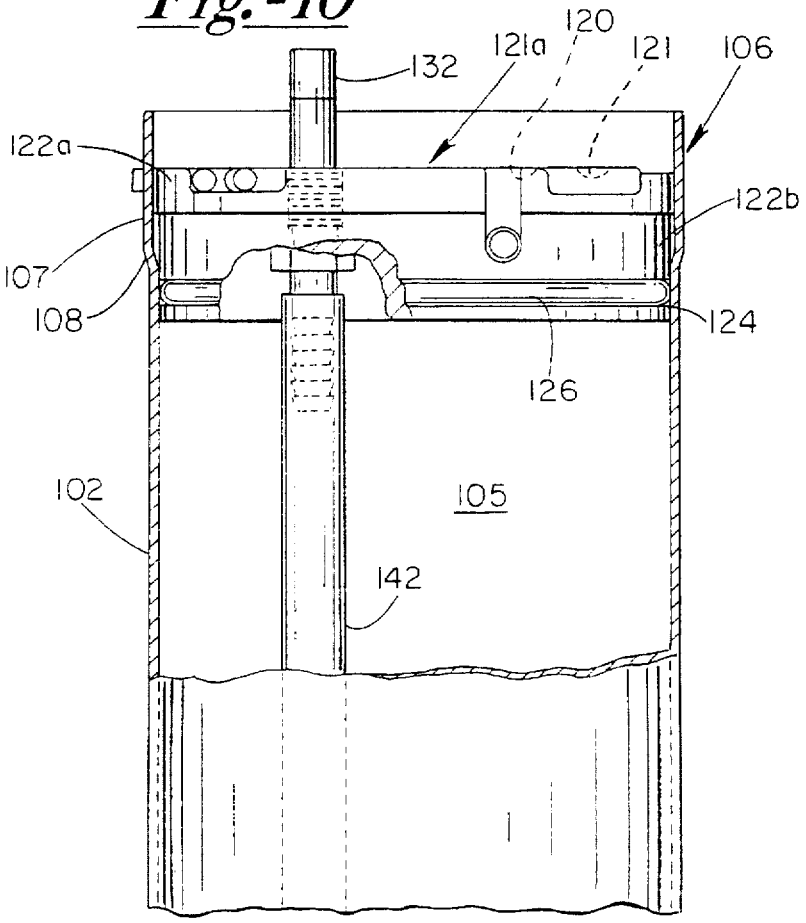

CARBONATOR

The present application obtains priority benefit pursuant to 35 USC Section 119(e) of U.S. provisional application Ser. No. 60/008,345, filed Dec. 7, 1995.

1. Field of the Invention

The present invention relates generally to carbonators for producing potable carbonated water.

2. Background of the Invention

Beverage carbonators are well known in the art and are utilized to produce potable carbonated water. Carbonated water is generally produced by mixing water and carbon dioxide gas under pressure in a containment cylinder. For reasons of providing for a reasonable safety margin, a carbonator cylinder must typically be able to withstand, without failure, pressures of approximately five to six times the normal operating pressure of 80 psi. Thus, such cylinders are constructed accordingly to be a single integral structure wherein any seams, such as represented by and end cap, are welded closed. Of course, access to the interior volume of the carbonator cylinder is necessary to deliver water and carbon dioxide gas thereto, to withdraw the carbonated water therefrom and to provide for a water level sensing means to regulate the flow of water into the cylinder. Typically, fittings are welded to the cylinder to provide for sealed fluid flow into and out of the cylinder. So that any potential for leaks is minimized, it is sometimes necessary that the level sensing means be sealed within the cylinder so that access thereto for repair or replacement is not possible without destruction of the cylinder.

A problem with such prior art carbonator cylinders concerns the amount of labor and hence cost that is involved in the manufacture thereof. That cost is directly related to the amount of welding, and the testing time needed to check against any leaks that could compromise the safety and performance thereof. As indicated above, it can also be a problem if the level sensing means fails and there is no way to gain access to it to effect a repair or a replacement. Accordingly, there had been a long felt need for a carbonator that is relatively easy and inexpensive to manufacture, that operates safely and effectively, and that can be easily disassembled, repaired and reassembled.

SUMMARY OF THE INVENTION

The carbonator of the present invention comprises a cylinder formed from a section of stainless steel pipe having a first end that has a formed stainless steel end cap welded thereto and a second opposite end having a removable end plate. The tubular body section second end is modified to have an end portion of slightly larger diameter than the nominal inside diameter thereof. Thus, an annular shoulder is created extending around an interior perimeter of the tubular body section at the juncture of the end portion and the remainder of the body thereof.

The end plate is circular and formed of a high density plastic material. The end plate has a first internal end portion that is of a smaller diameter than an external portion thereof creating an annular shoulder there between. The internal end portion includes an annular groove for receiving an o-ring. The internal portion has an outside diameter sized to fit within the main tubular body inside diameter whereby the o-ring provides for fluid tight sealing there between. The external plate portion has a diameter sized to fit within the inside diameter of the tubular body enlarged diameter end portion. Thus, the end plate is received within the tubular body second portion to a point where the annular shoulders thereof abut thereby preventing further movement of the end plate into the tubular body.

Four slots are formed through and around a perimeter of the second end of the tubular body external of a top surface of the end plate as it is normally held therein. A wire retainer is bent into a square having four radiussed corners. The retainer has two free ends that can be squeezed together to facilitate insertion of the four corners thereof into each of the four slots. In this manner the end plate is releasably retained in the tubular body second end.

All of the necessary fittings are secured to and extend through the end plate. Such fittings are metal and can be easily and quickly assembled with the plastic end cap by cold forming insertion therein. Such cold forming insertion provides for a high degree of quality with respect to minimizing leaks. The level sensing means is also secured to the end plate, and since the end plate is removable, it becomes cost effective to effect repair or replacement of the sensing means. In addition, the internal volume of the carbonator of the present invention can be easily cleaned.

In an alternate embodiment of the present invention, a section of tube is also utilized. However, both ends are blocked by plastic disks. In particular, both disks have a first internal o-ring receiving groove and a second retaining groove. Each disk is retained on the respective ends thereof by press forming an external annular groove into each end of the tube. The groove forms a corresponding internal ridge that is formed into the second retaining groove of each disk. One of the disks is used to receive the fittings and sensing means as described above. This alternate embodiment carbonator has the advantage of very simple and low cost construction.

DESCRIPTION OF THE DRAWINGS

A better understanding of the structure, and the objects and advantages of the present invention can be had by reference to the following detailed description which refers to the following figures, wherein:

FIG. 9 shows a top plan view of the embodiment of FIG. 8.

FIG. 10 shows a cross-sectional view along lines 10—10 of FIG. 9.

Figure 1:
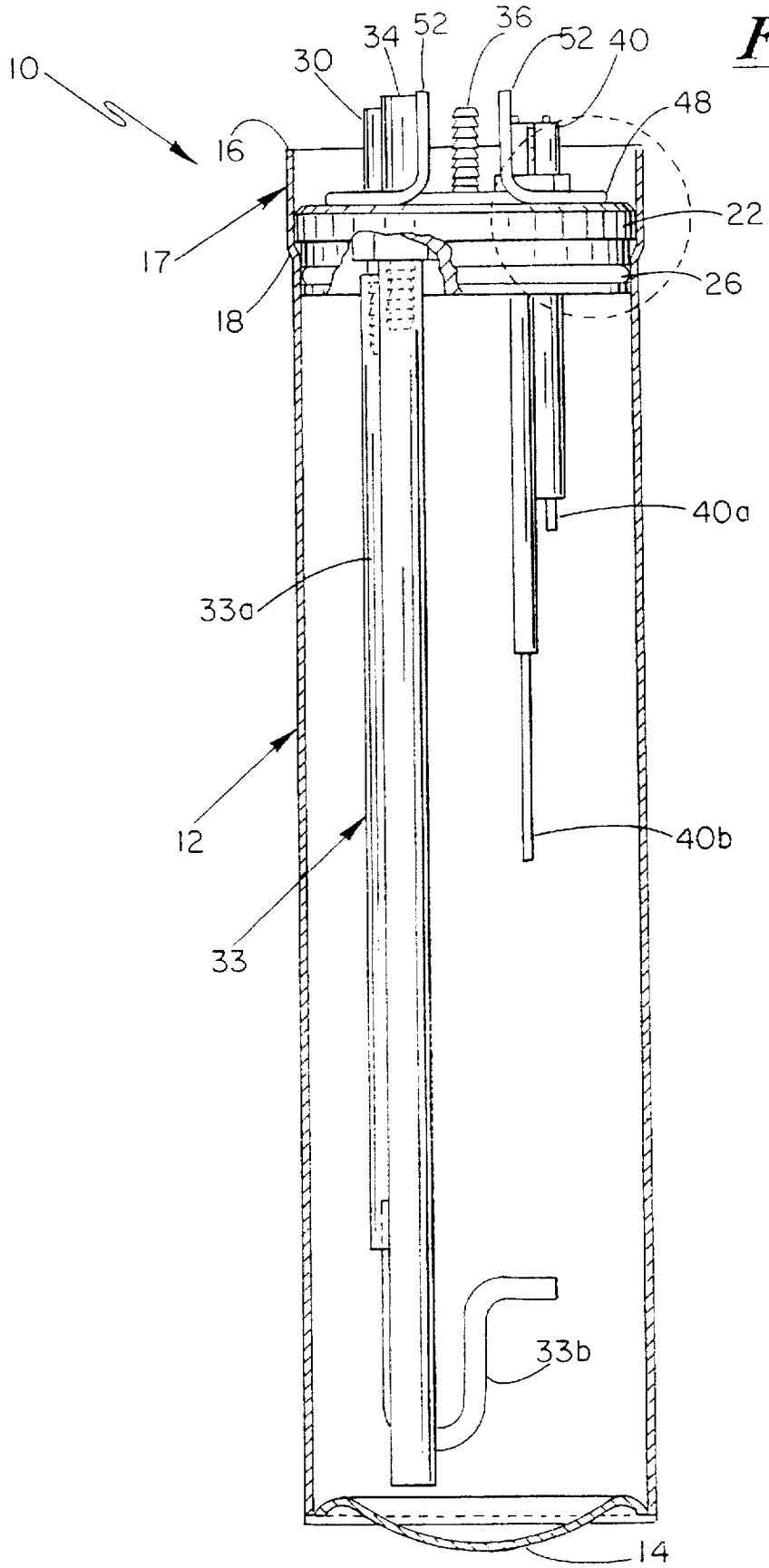
FIG. 1 shows a cross-sectional view of the present invention.

DETAILED DESCRIPTION OF THE PREFERRED EMBODIMENTS:

A carbonator of the present invention is seen in FIG. 1 and generally indicated by the numeral 10. A main body portion 12 is made of a section of stainless steel pipe to which an end cap 14 is welded forming a "bottom" end thereof and defining an internal volume 15. As will be understood by those of skill, main body 12 could also consist of an integral cylinder wall and bottom such as in a drawn cylinder having one open end. The opposite or "top" end 16 thereof is left open and includes an end portion 17 formed therein having a slightly greater diameter than the normal diameter of body portion 12. An annular ridge 18 is formed between end portion 17 and the remainder of body portion 12. End portion 17 includes four slots 20 equidistantly placed around a common perimeter thereof.

Figure 3:
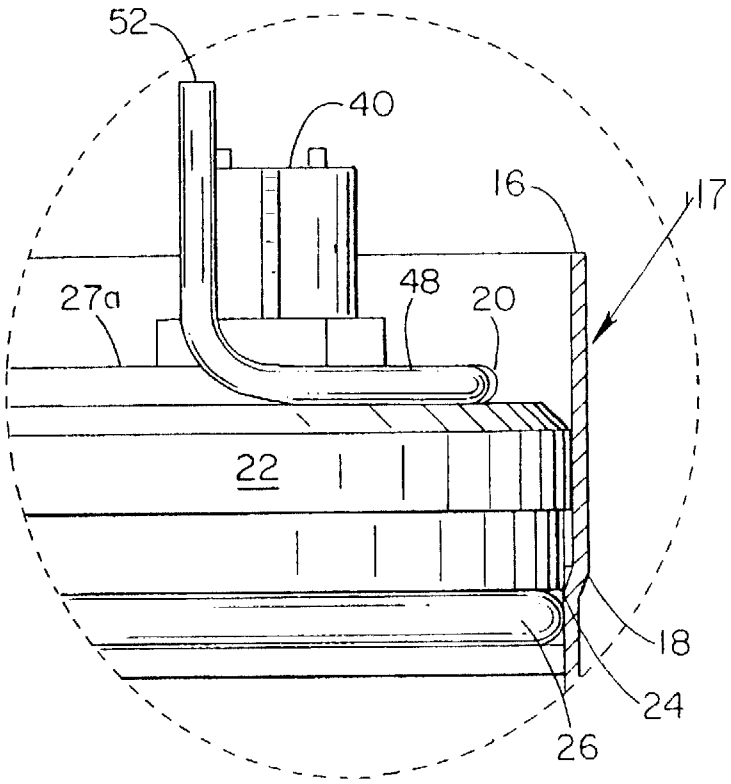
FIG. 3 shows a further enlarged view of the present invention.
Figure 2:
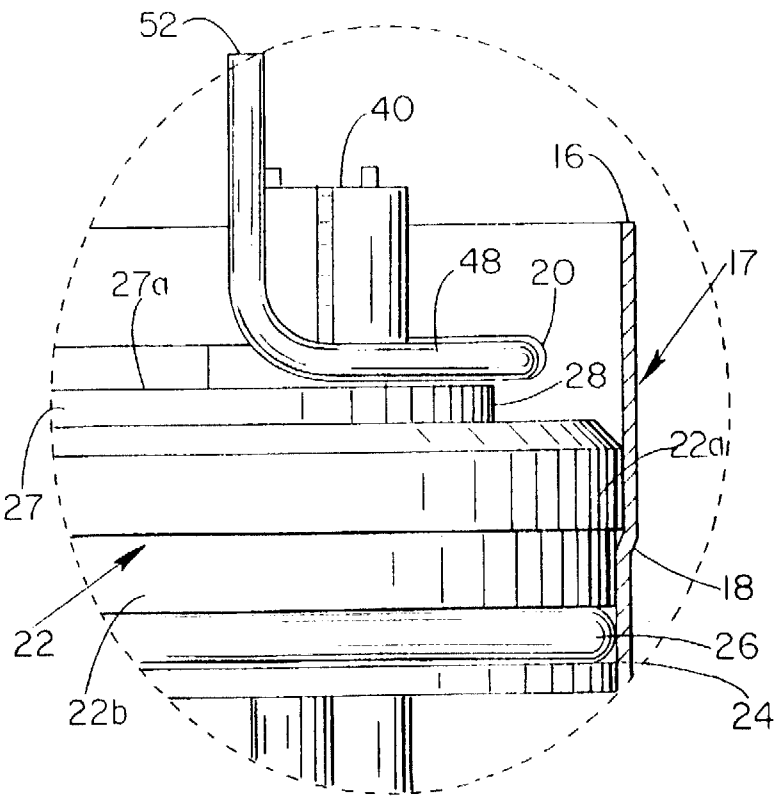
FIG. 2 shows an enlarged view of the present invention.
Figure 4:
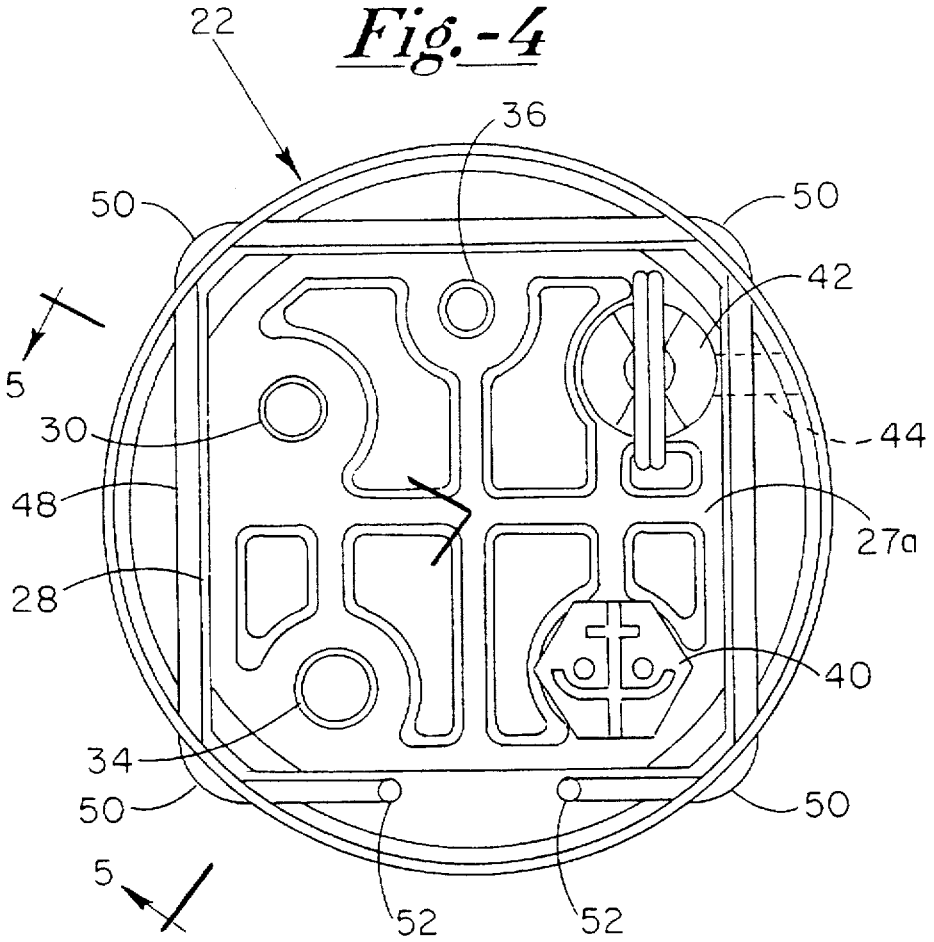
FIG. 4 shows a top plan view of the present invention.
Figure 5:
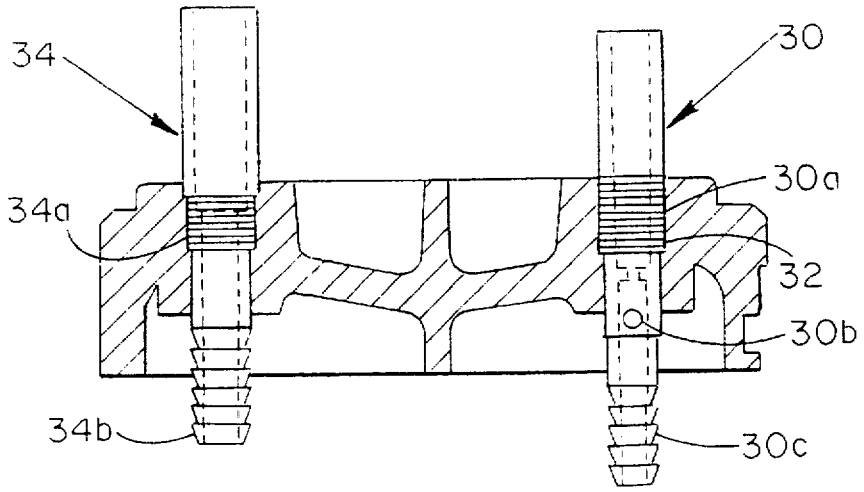
FIG. 5 shows a cross-sectional view along lines 5—5 of FIG. 4.
Figure 6:
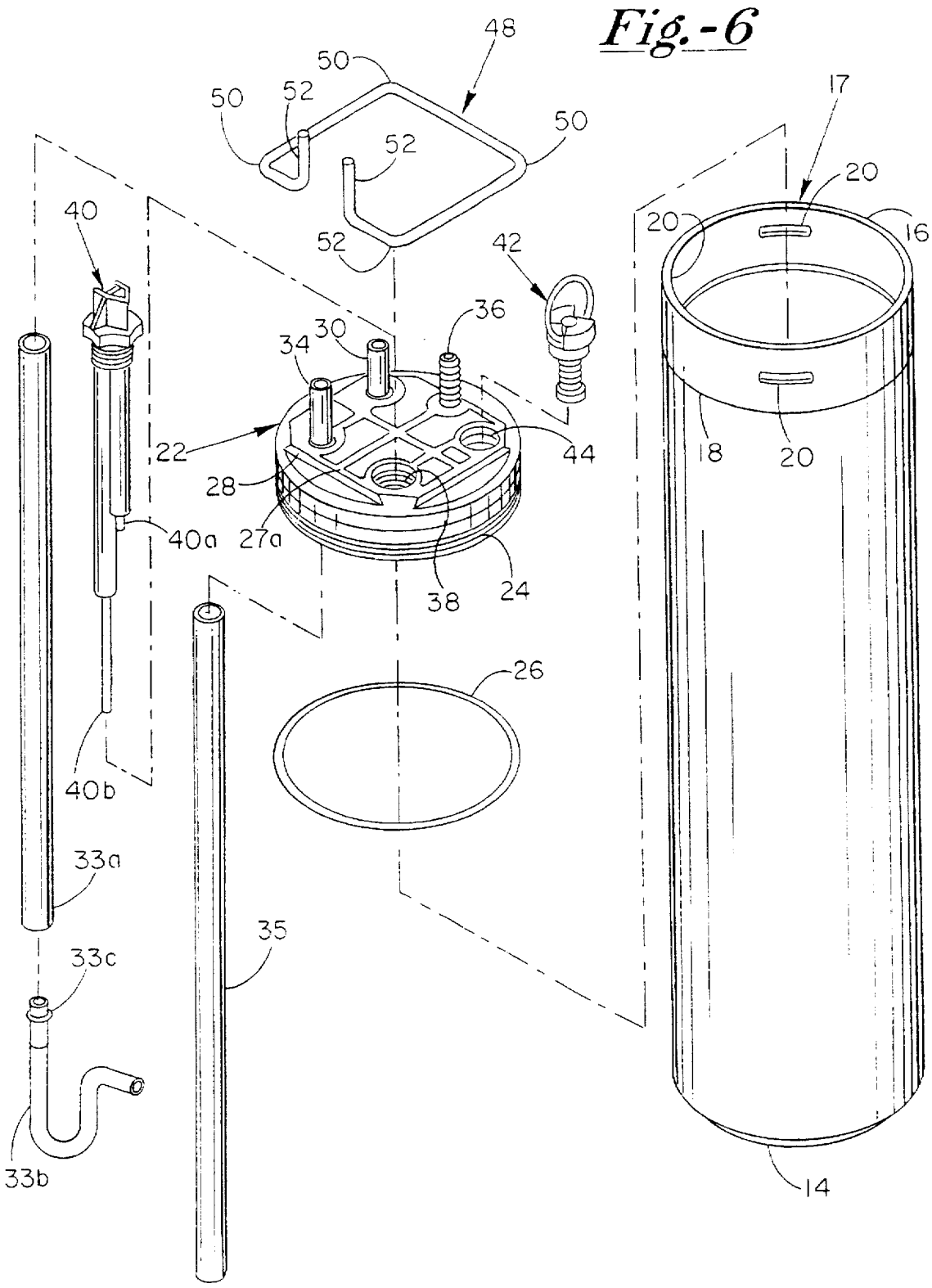
FIG. 6 shows an exploded view of the present invention.

As seen by also referring to FIGS. 2, 3 and 6, a circular end plug or disk 22 is slideably received within tube end 16. Disk 22 is made of a suitable high density plastic and includes an external portion 22*a* having a diameter slightly larger than an internal portion 22*b*. Internal portion 22*b* includes an annular groove 24 for receiving an o-ring 26 therein. Disk 22 includes a raised top portion 27 forming a top surface 27*a* and radiused vertical walls 28. A stainless steel water inlet fitting 30 includes a plurality of small barbs 30*a* around a central portion thereof, a water spray hole 30*b* and a plurality of larger annular tube retaining barbs 30*c* on one end thereof. Fitting 30 is press fit into a hole 32 extending through disk 22, where, as will be appreciated by those of skill, fitting 30 is sealingly secured to disk 22 in a fluid tight manner as the result of cold forming of the plastic material thereof by interaction with barbs 30*a*. A J-tube 33 is secured to inlet fitting 32 by insertion of barbs 30*c* therein. Tube 33 includes a straight portion 33*a* and a U-shaped portion 33*b*. Tube portion 33*a* can comprise a section of plastic tube. Tube portion 33*b* is made of stainless steel and formed into a U-shape, and includes a barbed end 33*c* for joining with tube portion 33*a*. In the same manner with fitting 30, a water outlet fitting 34 includes cold forming barbs 34*a* and hose fitting barbs 34*b*. An outlet tube 35 is secured to fitting 34 and extends therefrom to a point closely adjacent bottom end 14. Tube 35 can also be tubing of the same type as tube portion 33*a*. Also in the same manner, a carbon dioxide gas inlet fitting 36 includes cold forming barbs, not shown, and external hose fitting barbs 36*a*. Thus, fittings 32, 34 and 36 are all press fit into disk 22.

Disk 22 also includes a threaded orifice 38 for receiving a level sensing means 40. As will be apparent to those of skill, sensing means 40 is of the electrical conductivity type having two probe ends 40*a* and 40*b* for determining liquid level within carbonator 10 as a function of the presence or lack of electrical continuity there between. Various other liquid level sensing means could be utilized, such as those of the float type as is well understood in the art. A safety relief valve 42, also well known in the art, is threadably received within a hole 44. A safety gas relief orifice 46 extends from hole 44 to provide an escape path to the external surface of disk 22 for any gas relieved by valve 42 as the result of an overpressure situation.

A retaining wire 48 is bent into a square having three radiused corners 50. The two ends thereof include vertical portions 52 facing each other and spaced by a small distance. In operation disk 22 is inserted into tube end 16. As seen in FIGS. 2 and 3, disk portion 22*b* is sized to fit within the internal diameter of tube 12 and disk external portion is sized to fit closely within the internal diameter of tube end portion 17. As seen particularly in FIG. 2, when inserted into tube end 16 disk external portion 22*a* will eventually contact ridge 17 limiting further travel thereof in the direction of bottom end 14. In this position, it can be seen that slots 20 exist at a level above raised surface 27*a* and edges 28. Therefore, ends 52 or retainer 48 can be grasped and squeezed together thereby facilitating the placement of each of the four corners 50 thereof into one of the respective slots 20. In this position, retainer 48 prevents disk 22 from moving out of tube 12 when the internal volume 15 is pressurized. When under pressure, as represented in FIG. 3, disk 22 is pushed against retainer 48. In this position it can be seen that retainer 48 and slots 20 are now at a level even with edges 28 and below raised surface 27*a*. Thus, it will be appreciated by those of skill that retainer 48 can not be removed from cylinder 12 as the ends 52 thereof are prevented from together by contact with edges 28 whereby corners 50 can then not be removed from slots 20.

The basic operation of carbonator 10 to carbonate water is the same as that for prior art carbonators in the sense that water introduced through inlet 30 by a pump, not shown, is mixed with carbon dioxide gas introduced through inlet 36 from a pressurized source thereof, not shown. J-tube 33 provides for mixing of water with the gas as is known in the art, as does hole 30*b* that diverts a portion of the incoming stream of water into the carbon dioxide gas normally above the level of water therein. Carbonated water is drawn off by tube 35 for delivery to, for example, a plurality of beverage dispensing valves, not shown. Sensor 40 operates in the conventional way to signal the operation of the water pump to pump more water into carbonator 10 after a predetermined low water level is reached.

A major advantage of the present invention concerns the relative low cost of manufacture by using sections of stock pipe and using lower cost materials such as the plastic tubing. Another major advantage is that the disk 22 is removable by removal of retaining wire 48. Thus, the manufacture of carbonator 10 is simplified by eliminating some welding, and, if necessary, disk 22 can be removed in a cost effective manner to replace, for example, sensor 40 should it fail for some reason. In the past, carbonators were integral cylinders that could not be opened other than by cutting, which is cost prohibitive with respect to replacement or repair of the internal components thereof.

Figure 7:
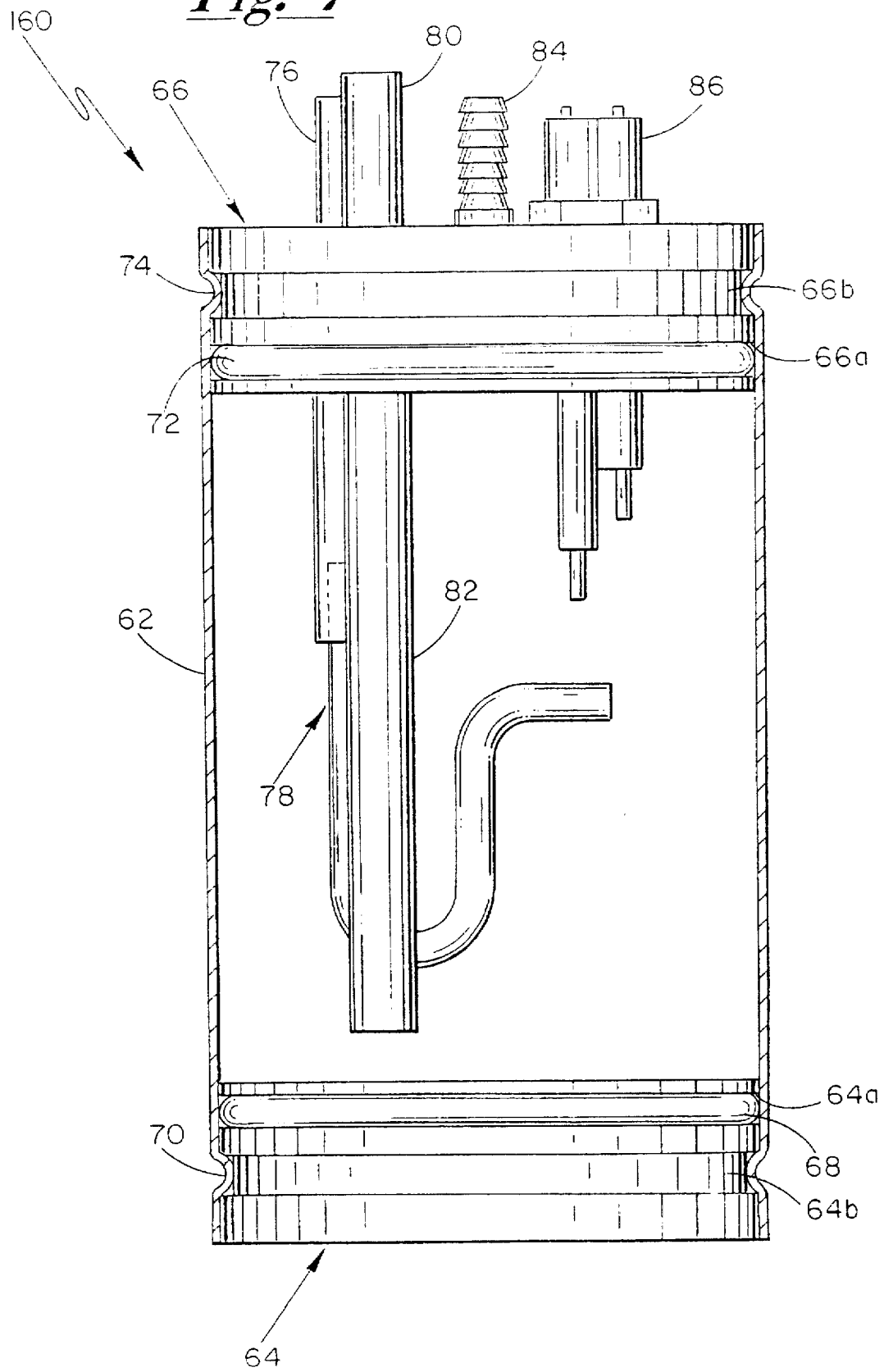
FIG. 7 shows a cross-sectional view of an alternate embodiment of the present invention.

A further embodiment of the present invention is seen in FIG. 7, and is generally indicated by the numeral 60. Carbonator 60 includes a main body pipe section 62 and a bottom end disk 64 and a top end disk 66. Disk 64 is simply a solid disk of high density plastic having an annular groove 64*a* for receiving an o-ring 68 and a further annular groove 64*b*. Disk 64 is permanently secured to tube 62 by the cold pressing of a corresponding annular groove 70 of pipe 62 into groove 64*b*. Disk 66 likewise includes an annular groove 66*a* for receiving an o-ring 72 and a further annular groove 66*b*. In the same manner as with disk 64, disk 66 is retained on an opposite end to pipe 62 by press forming of an annular groove 74 into pipe 62 into annular groove 66*b*. Disk 66, in a manner similar with disk 22 above, includes the various means for providing for the necessary fluid connections and so forth as above described. Thus, disk 66 includes a water inlet 76 having a J-tube 78, and water outlet 80 having a water outlet tube 82, a carbon dioxide gas inlet 84, a level sensing means 86 and a safety relief valve, not shown. Carbonator 60 operates in the manner above described for producing carbonated water. In contrast to carbonator 10 however, neither of the disk ends 64 or 66 are removable. However, the manufacture of carbonator 10 is very simple and of low cost. Disks 64 and 66 can be made of a flat stock material in which the various grooves and necessary orifices can be easily formed. Disks 64 and 66 could also be injection molded, as with disk 22, and disk 22 conversely could be cut from a flat stock material.

Figure 8:
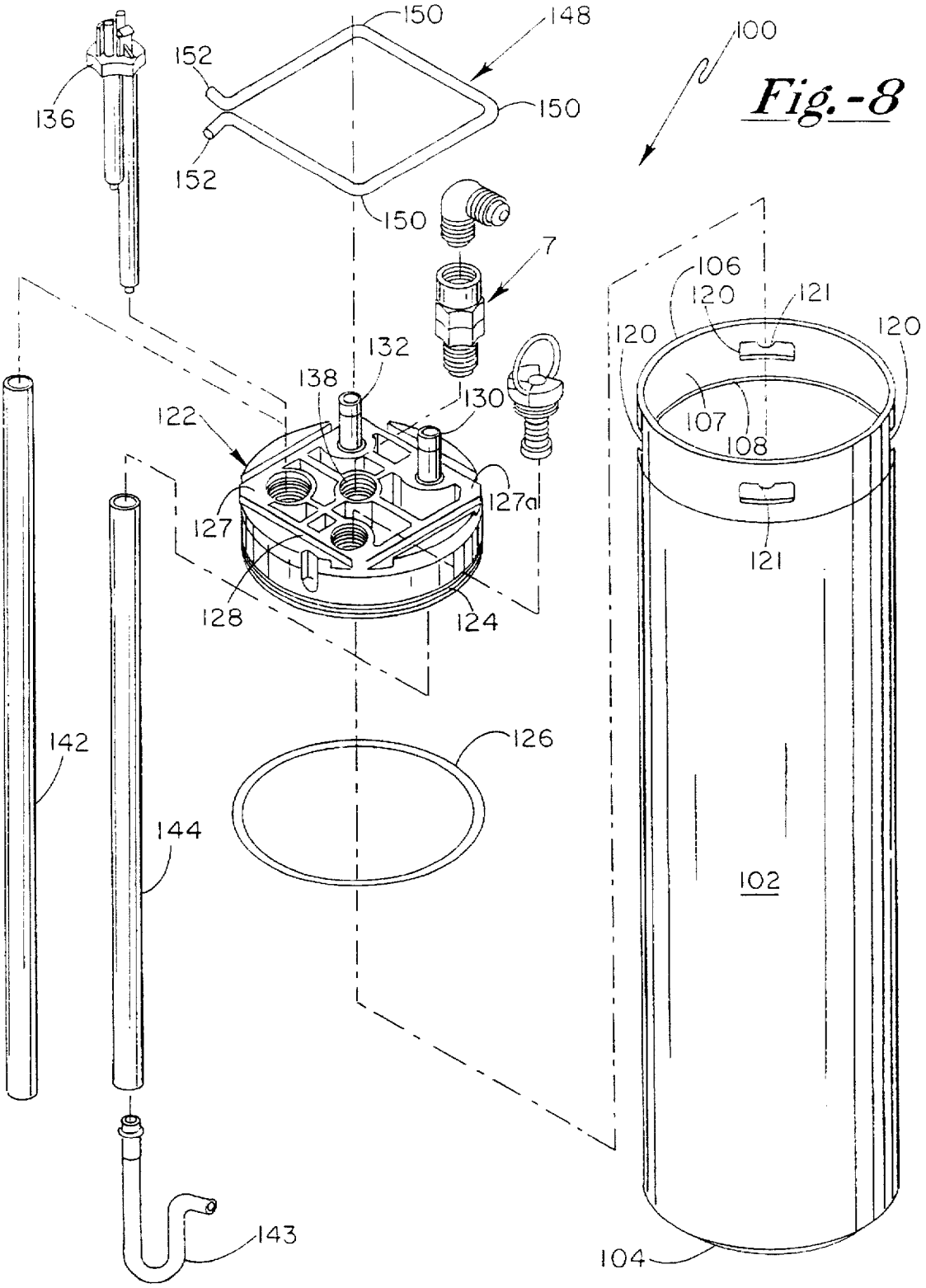
FIG. 8 shows an exploded view of a further embodiment of the present invention.

A further carbonator embodiment of the present invention is seen in FIGS. 8–10 and generally indicated by the numeral 100. Carbonator 100 is essentially the same as carbonator 10 except for certain changes noted below. A main body portion 102 is made of a section of stainless steel pipe to which an end cap 104 is welded forming a bottom end thereof and defining an internal volume 105. The opposite or top end 106 thereof is left open and includes an end portion 107 formed therein having a slightly greater diameter than the normal diameter of body portion 102. An annular ridge 108 is formed between end portion 107 and the remainder of body portion 102. End portion 107 includes four slots 120 equidistantly placed around a common perimeter thereof. However, slots 120, unlike slots 20 of carbonator 10, each include a wire retaining or blocking tab 121.

A circular end plug or disk 122 is slideably received within tube end 106. Disk 122 is substantially the same as disk 22 and is also made of a suitable high density plastic and includes an external portion **122*a* having a diameter slightly larger than an internal portion 122*b*. Internal portion 122*b* includes an annular groove 124 for receiving an o-ring 126 therein. Disk 122 includes a raised top portion 127 forming a top surface 127*a* and radiused vertical walls 128**.

In the same manner as disk 22, disk 122 includes a water inlet 130, a carbonated water outlet 132, a relief valve 134 and a level sensor 136. A carbon dioxide gas inlet opening 138 is also provided, however, unlike disk 22 it is located in the center of disk 122. A gas fitting 140 is threadably retained in opening 138. An outlet tube 142 is secured to fitting 132 and extends therefrom to a point closely adjacent bottom end 114. A J-tube 143 is connected to a straight tube 144 which is in turn connected to inlet 130.

A retaining wire 148 is bent into a square having three radiused or arcuate corners 150. The two ends thereof include bent portions 152 spaced by a small distance. In operation disk 122 is inserted into tube end 116. Disk portion **122*b* is sized to fit within the internal diameter of tube 102 and disk external portion 122*a* is sized to fit closely within the internal diameter of tube end portion 107. When inserted into tube end 106 disk external portion 122*a* will eventually contact ridge 108 limiting further travel thereof in the direction of bottom end 104. In this position, it can be understood that slots 120 are positioned so that retainer 148 can be grasped and positioned whereby each of the three corners 150 thereof can be positioned into one of the respective slots 120. Ends 152 will extend out of the remaining slot 120. In this position, retainer 148 prevents disk 22 from moving out of tube 12 when the internal volume 115 is pressurized. When under pressure, as represented in FIG. 10, disk 122 is pushed against retainer 148. In this position it can be seen that retainer 148 and slots 120 are now at a level even with edges 128 and below raised surface 127*a*. In particular tabs 121 will be positioned within the spaces internal of those radiused corners 150. Thus, it will be appreciated by those of skill that retainer 148 can not be removed from cylinder 112 as the ends 152 thereof are prevented from moving together by contact with edges 128. In addition corners 150 can not be removed from slots 120 as a result of the interference or blocking provided by tabs 121**.

We claim:

1. A carbonator, comprising:

a cylinder having a closed end and sidewalls extending therefrom to an open end and the sidewalls and closed end defining a cylinder interior space, a disk for insertion into the cylinder open end, the disk having an exterior surface and a water inlet means, a carbon dioxide gas inlet means and a carbonated water outlet means for providing sealed fluid communication through the disk into the cylinder interior space when the disk is retained in the cylinder open end and the disk having a sealing structure around a perimeter thereof for providing fluid sealing between the disk perimeter and an interior perimeter surface of the cylinder, and retaining means for permitting removable securing of the disk with the cylinder open end including a retaining wire for insertion into one or more slots formed in a perimeter of the cylinder adjacent the open end whereby the retaining wire is positioned between the cylinder open end and the disk exterior surface.

2. The carbonator as defined in claim 1, and the retaining wire having one or more arcuate portions for insertion into the one or more slots.

3. The carbonator as defined in claim 2, and where each slot includes a corner retaining tab.

4. The carbonator as defined in claim 3, and the retaining wire having two free ends for facilitating insertion and removal thereof from the one or more slots.

5. A carbonator, comprising:

a cylinder having a closed end and sidewalls extending therefrom to an open end and the sidewalls and closed end defining a cylinder interior space, a disk for insertion into the cylinder open end, the disk having an exterior surface and a water inlet means, a carbon dioxide gas inlet means and a carbonated water outlet means for providing sealed fluid communication through the disk into the cylinder interior space when the disk is retained in the cylinder open end and the disk having a sealing structure around a perimeter thereof for providing fluid sealing between the disk perimeter and an interior perimeter surface of the cylinder, and a retaining wire having a rectangular structure including three arcuate corners and two free ends, four slots formed equidistantly around a perimeter of the cylinder adjacent the open end, three of the four slots for receiving the three arcuate corners therein and the remaining fourth slot for receiving the retaining wire free ends there through whereby the retaining wire is positioned between the cylinder open end and the disk exterior surface.

6. The carbonator as defined in claim 5, and where each slot includes a corner retaining tab.

7. The carbonator as defined in claim 5, and the retaining wire free ends normally spaced from each other whereby moving of the free ends towards each other provides for facilitating insertion of the arcuate corners into the slots and removal of the arcuate corners there from.

8. The carbonator as defined in claim 7, and the disk exterior surface defining a vertical wall surface structure for blocking movement of the free ends together when the interior volume of the cylinder is pressurized.

9. The carbonator as defined in claim 8, and where each slot includes a corner retaining tab.

10. A carbonator, comprising:

a cylinder having a closed end and sidewalls extending therefrom to an open end and the sidewalls and closed end defining a cylinder interior space and the cylinder having an annular shoulder extending around an interior perimeter thereof defining a cylinder end portion having a first interior diameter and a cylinder body portion having a second interior diameter larger than the first interior diameter, a disk for insertion into the cylinder open end, the disk having an interior portion having a first external perimeter diameter and an exterior portion having a second external perimeter diameter larger than the first external perimeter diameter forming a disk annular shoulder there between, and the exterior portion having an exterior surface, and the disk including a water inlet means, a carbon dioxide gas inlet means and a carbonated water outlet means for providing sealed fluid communication through the disk into the cylinder interior space when the disk is retained in the cylinder end portion, and the disk having a sealing structure around the interior portion for providing fluid sealing between the interior portion and an interior surface of the cylinder body portion, and a retaining wire having a rectangular structure including three arcuate corners and two free ends, and four slots formed equidistantly around a perimeter of the cylinder end portion adjacent the open end, three of the slots for receiving the three arcuate corners therein and the remaining fourth slot for receiving the retaining wire free ends there through whereby the retaining wire is positioned between the cylinder open end and the disk exterior surface.

11. The carbonator as defined in claim 10, and where each slot includes a corner retaining tab.

12. The carbonator as defined in claim 10, and the retaining wire free ends normally spaced from each other whereby moving of the free ends towards each other provides for facilitating insertion of the arcuate corners into the slots and removal of the arcuate corners there from.

13. The carbonator as defined in claim 12, and the disk exterior surface defining a vertical wall surface structure for blocking movement of the free ends together when the interior volume of the cylinder is pressurized and where the disk interior and exterior portions and the cylinder end and body portions are sized so that the disk interior portion remains in sealing relationship with the interior surface of the cylinder body portion.

14. The carbonator as defined in claim 13, and the disk having a maximum insertion position in the cylinder as defined by contact between the disk annular shoulder and the cylinder annular shoulder and when in the position of such contact there between the vertical wall surface structure of the disk does not block movement together of the retaining wire free ends.

15. The carbonator as defined in claim 14, and where each slot includes a corner retaining tab.

* * * * *